US006502492B1

(12) United States Patent
Krohmer et al.

(10) Patent No.: US 6,502,492 B1
(45) Date of Patent: Jan. 7, 2003

(54) ADJUSTABLE MITER ATTACHMENT

(75) Inventors: Steven D. Krohmer, Coon Rapids, MN (US); Donald F. Nawrocki, Stannwood, WA (US)

(73) Assignee: Rockler Companies, Inc., Medina, MN (US)

( * ) Notice: Subject to any disclaimer, the term of this patent is extended or adjusted under 35 U.S.C. 154(b) by 49 days.

(21) Appl. No.: 09/663,410

(22) Filed: Sep. 15, 2000

(51) Int. Cl.[7] ..... B26D 7/06
(52) U.S. Cl. ..... 83/435.13; 33/471; 83/435.14
(58) Field of Search ..... 83/435.12, 435.13, 83/435.14, 477.2, 581, 432; 269/304; 33/471, 469, 497

(56) References Cited

U.S. PATENT DOCUMENTS

| | | | | |
|---|---|---|---|---|
| 1,985,614 | A | | 12/1934 | Merrigan |
| 2,010,882 | A | | 8/1935 | Ocenasek |
| 4,514,909 | A | * | 5/1985 | Gilbert |
| 4,741,387 | A | | 5/1988 | Strong |
| 4,793,604 | A | | 12/1988 | Taylor |
| 5,042,346 | A | | 8/1991 | McCann |
| 5,195,730 | A | | 3/1993 | Taylor |
| 5,402,581 | A | | 4/1995 | Hurt |
| 5,402,701 | A | | 4/1995 | Ingram |
| 5,617,909 | A | | 4/1997 | Duginske |
| 5,716,045 | A | | 2/1998 | Taylor |

OTHER PUBLICATIONS

Miter Gauge Art from RogRoc, May 22, 2000, one page.

* cited by examiner

*Primary Examiner*—Kenneth E. Peterson
(74) *Attorney, Agent, or Firm*—Gerald Helget; Nelson Capes; Briggs and Morgan

(57) ABSTRACT

An adjustable miter attachment for use with a saw table consists of a miter slot bar which can be inserted into a miter slot in a saw table, the miter slot bar having a circular miter gauge attachment portion with a first axis therethrough; a circular adjustable miter gauge with a second axis therethrough engaging the circular miter gauge attachment portion for stepwise rotation upon the miter gauge attachment portion and the first axis coinciding with the second axis; and a locking member adapted to lock the adjustable miter gauge to the miter gauge attachment portion at each step of rotation. The miter gauge is adjustable in fine increments to produce various angles of the miter fence relative to the table top. The miter bar is adjustable for various slot widths in the table top.

3 Claims, 2 Drawing Sheets

10
F
20
30,32
4
50
X2
34
X1
42
14
40
12
5
12B
12A
76
70,72
T
S
12

12
76
12A
12B
70

12
20
14
34
32
30
52
42

70, 72
12A
T
S
12B
K 12
20
52
40

ADJUSTABLE MITER ATTACHMENT

BACKGROUND OF THE INVENTION

The present invention relates to an adjustable miter attachment for a table such as a saw table, and particularly to an adjustable miter attachment in which the miter gauge is rotationally adjustable in fine increments to set the angle of the miter fence relative to the table top, and in which the miter bar is adjustable for different slot widths and configurations in the table top.

Adjustable miter gauges are known, as evidenced by U.S. Pat. No. 2,010,882 (Ocenasek). A problem with the Ocenasek device is that the axis of rotation of the miter gauge is offset from the indexing area on the miter bar, so that the arc produced by rotation of the miter gauge takes up unnecessary space. Another problem with the Ocenasek device is that, other than at the widely-spaced slots 24, the gauge is held in place only by friction, that is, there is no positive interlock with the miter bar other than at the widely-spaced points 24, which only allow adjustment in increments of 15 degrees.

Another adjustable miter gauge, disclosed in U.S. Pat. No. 1,985,614 (Merrigan) has the same problems as the Ocenasek device.

There is a need for an adjustable miter attachment that allows adjustment in fine increments (i.e., about 2.5 degrees) while locking the gauge at each increment.

There is also a need for an adjustable miter bar which can be adjusted to various slot widths on the saw table.

SUMMARY OF THE INVENTION

An adjustable miter attachment for use with a saw table, comprising:

a) a miter slot bar adapted to be inserted into a miter slot in a saw table;

b) the miter slot bar having a circular miter gauge attachment portion with a first axis therethrough;

c) a circular adjustable miter gauge with a second axis therethrough engaging the circular miter gauge attachment portion for stepwise rotation upon the miter gauge attachment portion and the first axis coinciding with the second axis; and d) a locking member adapted to lock the adjustable miter gauge to the miter gauge attachment portion at each step of rotation.

A principle object and advantage of the present invention is that the miter gauge is adjustable in fine increments (i.e., about 2.5 degrees) to various angles of the miter fence relative to the tabletop.

Another principle object and advantage of the present invention is that the miter gauge is securely locked in place at each of the incremental angles by interlocking slots on the gauge and miter bar, and does not depend on friction for locking.

Another principle object and advantage of the present invention is that the axis of rotation of the miter gauge is coincident with its axis of attachment to the miter bar, resulting in less space needed for the miter gauge.

Another principle object and advantage of the present invention is that the miter bar is adjustable for various slot widths in the tabletop.

DETAILED DESCRIPTION OF THE PREFERRED EMBODIMENT

Figures 1, 5A, 5B:
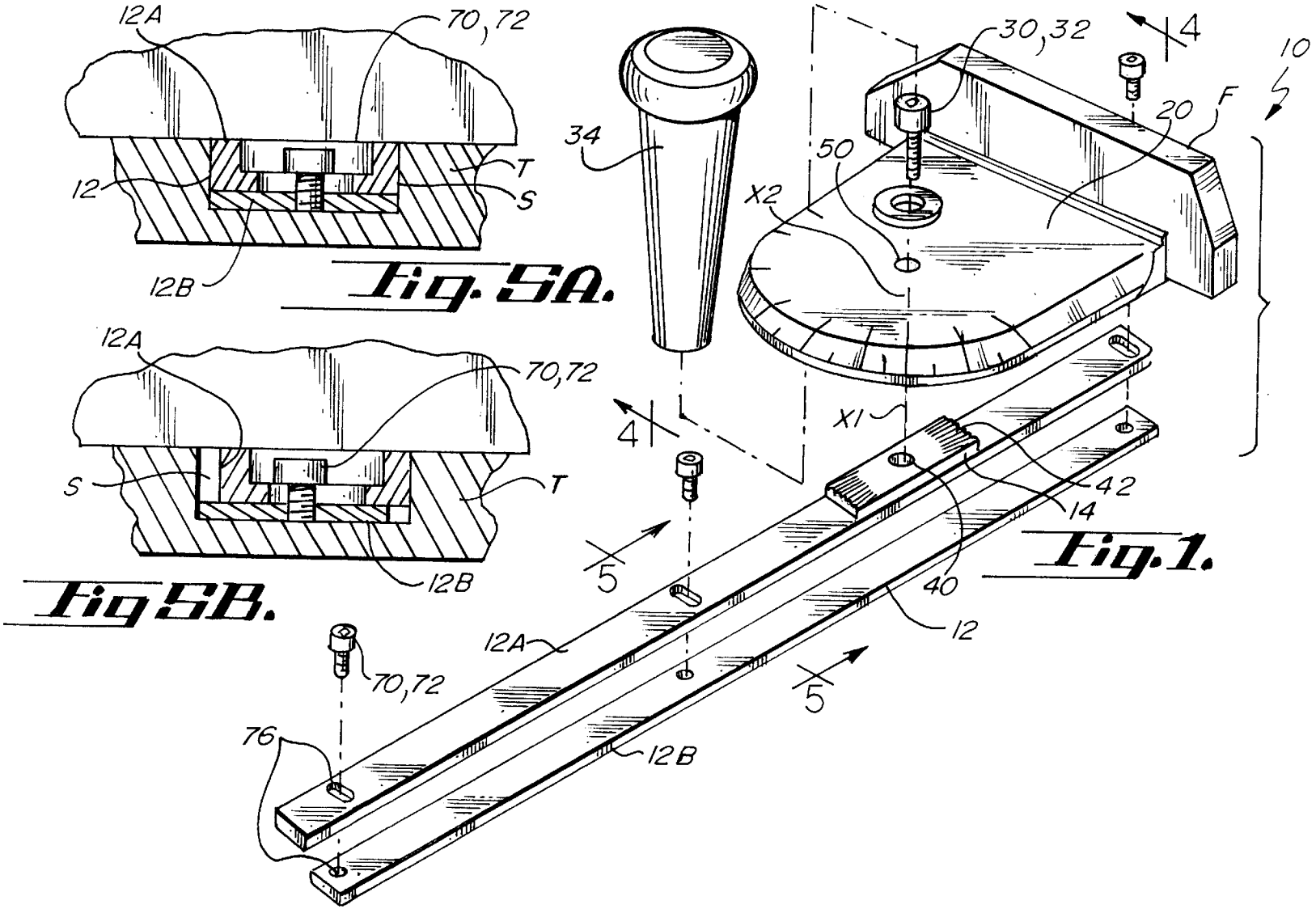
FIG. 1 is an exploded view of the adjustable miter attachment of the present invention.
FIGS. 5A, 5B, and 5C are cross sections taken at about the lines 5 of FIG. 1.

The adjustable miter attachment of the present invention is generally shown in the Figures as reference numeral 10.

Adjustable miter attachment 10 comprises a miter slot bar 12 adapted to be inserted into a miter slot S in a table T. The miter slot bar 12 preferably has a circular miter gauge attachment portion 14 with a first axis X1 therethrough. However, the slot bar 12 can also be used in other applications not requiring a miter gauge.

A circular adjustable miter gauge 20 with a second axis X2 therethrough engages the circular miter gauge attachment portion 14 with the first axis X1 coinciding with the second axis X2.

A locking member 30 locks the adjustable miter gauge 20 to the miter gauge attachment portion 14 at each step of rotation, as will be further explained.

More particularly, the miter gauge attachment portion 14 further comprises a miter gauge attachment aperture 40 and a plurality of radially directed miter gauge adjustment slots 42 centered upon the miter gauge attachment aperture 40. Axis X1 is coincident with the miter gauge attachment aperture 40. Preferably, the miter gauge attachment portion 14 is machined into the miter slot bar 12.

In order to allow for very fine adjustment of the miter gauge 20 about axis X2, each of the plurality of miter gauge adjustment slots 42 occupies about 2.5 degrees of arc.

Mating with the miter gauge attachment portion, the adjustable miter gauge 20 further comprises a miter slot bar attachment aperture 50 and a plurality of radially directed miter slot bar adjustment slots 52 centered upon the miter slot bar attachment aperture 50 and engaging the plurality of miter gauge adjustment slots 42. Locking member 30 engages the miter gauge attachment aperture 40 and the miter slot bar attachment aperture 50 to lock the miter gauge 20 to the miter gauge attachment portion 14. Preferably, the locking member 30 further comprises a screw 32 and a handle 34 attached to the screw 32. Most preferably, the screw 32 and the handle 34 are of a single piece.

Operation of the miter gauge is as follows. In order to position the fence F at a variety of angles relative to the miter slot bar 12, and thus at a variety of angles to the table T, the operator loosens the locking member 30 and then rotates the miter gauge 20 about its axis X2. Stepwise rotation will occur because of the successive engagement of the slots 42 with corresponding slots 52, and the miter gauge 20 cannot be positioned at angles between slots 42, 52. Once the proper angle is achieved, the locking member 30 is tightened and in conjunction with slots 42, 52 engaging each other, the locking member 30 then prevents rotation of the miter gauge 20.

Figures 2, 3, 4, 5C:
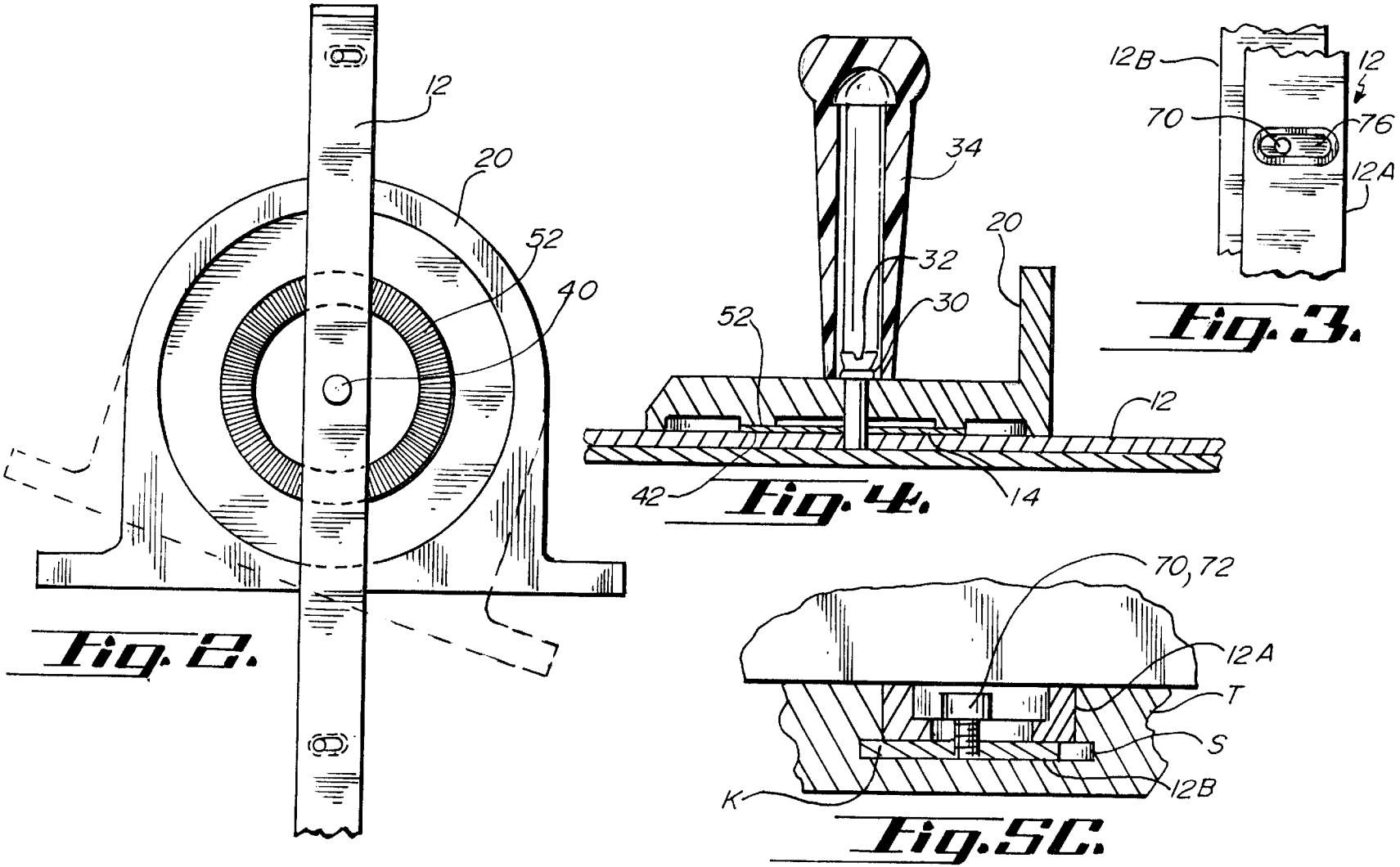
FIG. 2 is a bottom plan view of the adjustable miter attachment of the present invention.
FIG. 3 is a fragmentary top plan view of the adjustable miter slot bar of the present invention.
FIG. 4 is a cross section taken at about the lines 4 of FIG. 1.

Another aspect of the invention is that the miter slot bar 12 is adjustable for various miter slot S widths, as shown in FIGS. 5A, 5B, and 5C. The miter slot bar 12 further comprises a pair of elongate parallel members 12A, 12B slidingly engaged along their length in the direction of their widths or laterally.

In FIG. 5A, the slot S is of such a width that the elongate parallel members 12A, 12B, when coincident along their length, fill the slot S.

In FIG. 5B, the slot S is wider than either of the elongate parallel members 12A, 12B. To fill the slot S, the members 12A, 12B are offset from each other along their lengths.

In FIG. 5C, the slot S is wider than either of the elongate parallel members 12A and 12B. Furthermore, the slot S has a keyway K into which parallel member 12B may extend to lock the miter slot bar 12 to the table T.

A hold-down member 70 locks the parallel members 12A, 12B to one another. The hold-down member 70 preferably comprises a screw 72 threadably engaging hold-down apertures 76 in each of the parallel members.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An adjustable miter attachment, comprising:

(a) a miter slot bar adapted to be inserted into a miter slot in a table;

(b) the miter slot bar having a circular miter gauge attachment portion with a first axis therethrough;

(c) a circular adjustable miter gauge with a second axis therethrough engaging the circular miter gauge attachment portion for stepwise rotation upon the miter gauge attachment portion and the first axis coinciding with the second axis;

(d) a locking member adapted to lock the adjustable miter gauge to the miter gauge attachment portion at each step of rotation; and (e) wherein the miter gauge attachment portion further comprises a miter gauge attachment aperture and a plurality of radially directed miter gauge adjustment slots centered upon the miter gauge attachment aperture, wherein the adjustable miter gauge further comprises a miter slot bar attachment aperture and a plurality of radially directed miter slot bar adjustment slots centered upon the miter gauge attachment aperture and engaging the plurality of miter gauge adjustment slots, and further comprising a locking member engaging the miter gauge attachment aperture and the miter slot bar attachment aperture to lock the miter gauge to the miter gauge attachment portion.

2. The adjustable miter attachment of claim 1, wherein the miter gauge attachment portion is machined into the miter slot bar.

3. The adjustable miter attachment of claim 1, wherein each of the plurality of radially directed miter gauge adjustment slots occupies about 2.5 degrees of arc.

* * * * *